United States Patent [19]

Messinger et al.

[11] 4,283,848

[45] Aug. 18, 1981

[54] DRYSHAVER

[75] Inventors: Werner Messinger, Kronberg; Roland Ullmann, Hausen; Otto Schweingruber, Glashütten, all of Fed. Rep. of Germany

[73] Assignee: Braun Aktiengesellschaft, Frankurt am Main, Fed. Rep. of Germany

[21] Appl. No.: 80,784

[22] Filed: Oct. 1, 1979

[30] Foreign Application Priority Data

Oct. 9, 1978 [DE] Fed. Rep. of Germany ..... 2843947

[51] Int. Cl.[3] ..... B26B 19/00

[52] U.S. Cl. ..... 30/34.1

[58] Field of Search ..... 30/34.1, 90

[56] References Cited

U.S. PATENT DOCUMENTS

| | | | |
|---|---|---|---|
| 3,780,434 | 12/1973 | de Boer | 30/34.1 |
| 3,962,783 | 6/1976 | Rentema | 30/34.1 |
| 4,050,151 | 9/1977 | de Boer | 30/34.1 |
| 4,085,503 | 4/1978 | Beck | 30/34.1 |

FOREIGN PATENT DOCUMENTS

| | | | |
|---|---|---|---|
| 1444458 | 7/1976 | United Kingdom | 30/34.1 |

*Primary Examiner*—Jimmy C. Peters

*Attorney, Agent, or Firm*—Michael J. Striker

[57] ABSTRACT

A dryshaver has a beard cutter and a drive which powers the same. The dryshaver also has a long-hair trimmer and a fist slide on which the trimmer is mounted and which is movable to and from an operating position in which the trimmer is operatively coupled with the drive to be powered by the same. A switch is provided which controls the supply of electrical energy to the drive, and a second slide—mounted on or in the first slide for movement relative to the same—has a projection which activates or de-activates the swtich in dependence upon the movement of the second slide.

12 Claims, 8 Drawing Figures

DRYSHAVER

BACKGROUND OF THE INVENTION

The present invention relates to a dryshaver, and more particularly the invention relates to a dryshaver of the type having a trimmer for long hair.

Already on the market are dryshavers having the conventional beard cutter as well as a long-hair trimmer which can be moved to and from an operating position by a control member of a dual-function switch. This switch can be moved from a rest position to a first operating position in which it energizes the drive for the beard cutter, and it can be moved beyond this first operating position to a second position in which the beard cutter continues to be energized but in which the long-hair trimmer is itself moved to operating position and becomes coupled with the drive of the dryshaver so as to be energized. An advantage of this construction is that whenever the dryshaver is de-energized, the long-hair trimmer must automatically also be de-energized, and conversely that when only the beard cutter is to be used, the long-hair trimmer need not be activated and is thus not subject to unnecessary wear. Moreover, the long-hair trimmers require a relatively substantial amount of energy for their operation so that the above construction tends to save energy, which is particularly important if the dryshaver is battery-operated since it prevents premature exhaustion of the batteries. To the extent described above, the known prior-art construction on the market is fully satisfactory. However, there is another problem which is only partly solved in the prior art, namely to assure maximum access of the beard cutter to all regions of the face, even those which are difficult to reach. To assure such optimum access it is necessary that the long-hair trimmer be in a rest position in which it is out of the way and does not interfere with the desired use of the beard cutter. However, in the prior art the long-hair trimmer is automatically moved from its rest position to an intermediate position when the drive for the beard cutter is activated, so that it moves to a location in which, although it is not itself operative, it may interfere with the freedom of the beard cutter to reach those regions of the face where access is difficult.

SUMMARY OF THE INVENTION

It is, accordingly, a general object of the present invention to avoid the disadvantages of the prior art.

More particularly, it is an object of the present invention to provide an improved dryshaver in which the long-hair trimmer can remain in its rest position when only the beard cutter is to be energized and used, so as to avoid inteference with the access of the beard cutter to all parts of the face.

Another object of the invention is to provide such an improved dryshaver in which the beard cutter can be energized and de-energized, and the long hair trimmer can be moved to and from its operating position, without requiring elaborate switching and, in fact, without requiring that the user change the position of his fingers on the dryshaver which he is holding.

In keeping with the above objects, and with others which will become apparent hereafter, one aspect of the invention resides, in a dryshaver, in a combination which comprises a drive, a long-hair trimmer, a first slide mounting the trimmer and being movable to and from an operating position in which the trimmer is operatively coupled with the drive to be powered by the same, and switch means, including a second slide provided at and movable relative to the first slide, for energizing and de-energizing the drive.

With this construction only the first slide is moved to energize and de-energize the drive for the beard cutter, so that the long-hair trimmer can remove in its rest position in which it is out of the way and does not interfere with the proper use of the beard cutter. Also, since the second slide which controls movement of the long-hair trimmer to the operating position and also controls the coupling of the long-hair trimmer with the drive, is mounted on or in the first slide, the user can readily operate the long-hair trimmer with the same finger or fingers used to energize and de-energize the beard cutter, so that he does not have to shift the position of his hand on the housing of the dryshaver. This makes for maximum ease and comfort of use and yet overcomes the disadvantages outlined above with respect to the prior art.

The second slide may, as already pointed out before, be mounted on the first slide or it may be mounted in the first slide, i.e. in a recess of the same. Of course, the first slide must be of relatively large size since it not only is a slide but also carries the long hair trimmer itself. Because of this, there is more than adequate room for the second slide to be provided on or in the first slide, and a further advantage of this arrangement is that provision for the arrangement of the slides need be made at only one location of the housing, rather than having to make separate provisions at different housing portions.

The second slide may move either in the same direction as the first slide or it may move transversely to the movement of the first slide. It is clear, of course, that although each of the slides can be operated separately, it is also possible to operate them jointly by, for example, having one finger bridging and engaging both of the slides. Moreover, a simple glance immediately indicates in this construction whether the long-hair trimmer is in operating position or in rest position, so that it is entirely unlikely that for reasons of neglect or forgetfulness the long-hair trimmer may remain energized at all times and thus waste energy and be subject to unnecessary wear.

If the two slides are movable in one and the same direction, then the arrangement can be such that the second slide will, after traversing part of its path, take along the first slide. In other words, the second slide would move relative to the first slide for a first distance, and when it is moved beyond this first distance it would then cooperate with appropriate portions of the first slide and take along the same. The reverse cooperation is, of course, also possible, and this arrangement assures further ease of handling for the user. In fact, this arrangement is somewhat preferred over the arrangement where the second slide moves transverse to the first slide, because it can be more readily mounted in the housing of the dryshaver.

Another advantageous feature is the first slide mounting the long-hair trimmer to be maintained in its two opposite end positions by spring means, so that the user who moves the first slide from one to the other of the end positions need overcome only resistance at the center point, after which the first slide will automatically snap to one or the other of its end positions depending upon the direction to which it is being moved.

This assures that in the operating position of the first slide the long-hair trimmer is completely coupled with the drive of the dryshaver, because this biasing action always guarantees that the first slide will move fully to its respective end position instead of stopping perhaps slightly before reaching the end position.

Still another advantageous aspect of the invention is to provide the second slide on the first slide in such a manner that it is movable between two abutments. As long as the dryshaver is only switched on or off, the position of the first slide and thus the position of the long-hair trimmer does not change. If, however, the second slide is moved beyond the energizing or de-energizing positions, then it engages the respective abutments and takes along the first slide either to the operating position or to the rest position of the same.

Pressure springs may be provided which tend to bias the first slide towards its rest position. In this case de-activation of the dryshaver results in automatic return of the first slide and therefore of the long-hair trimmer, to their rest positions. The long-hair trimmer then cannot be energized (even though the beard cutter may be energized) as a result of being left in its operating position due to forgetfulness or carelessness; it will automatically be returned to its rest position. Such biasing springs may be provided either in the frame of the shear head or in the housing of the dryshaver.

The second slide may be provided with snap-in detents which permit it to maintain the first slide in operating position so that the first slide cannot be returned to its rest position by the biasing springs until the engagement of the snap-in detents is deliberately terminated by the user.

The second slide will be provided with a projection which engages an operating member of a switch to be controlled by the second slide, in dependence upon movements of the second slide relative to the first slide and to the switch. Moreover, the second slide may, as already pointed out before, be located in a recess of the first slide, and all of this assures that the combined first and second slides will be in form of a relatively thin component which can be readily installed in or on the housing and is not aesthetically displeasing.

Finally, another and very advantageous embodiment of the invention provides for the first slide to have two detents which determine the two end positions of the second slide, and into which a projection or portion of the second slide can snap in the end positions of the latter. Furthermore, the housing is provided with an abutment edge which prevents a snapping-out of this portion of the second slide from the detent associated with the rest position of the second slide, as long as the first slide is in its own rest position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 2:
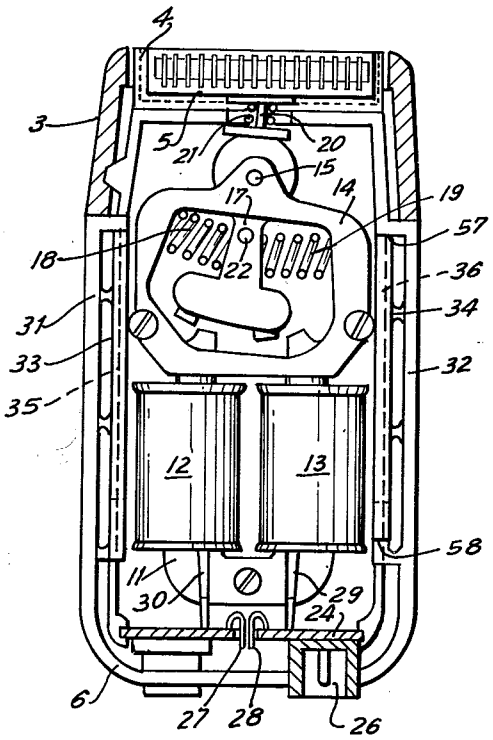
FIG. 2 is a view similar to FIG. 1, but partly in vertical section and with elements removed to show the interior of the dryshaver of FIG. 1.
Figure 1:
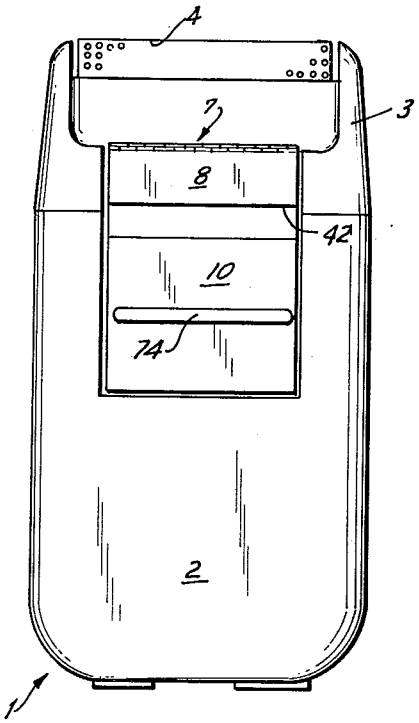
FIG. 1 is a somewhat diagrammatic side elevational view illustrating a dryshaver embodying the invention.

Referring firstly to FIG. 1 it will be seen that the dryshaver there illustrated has a housing 1 which is composed of two shell-like housing sections 2 and 6 of which only the section 2 is visible in FIG. 1 (section 6 is visible in FIG. 2). The gear head frame 3 is mountable on the housing 1 and mounted in the same is a shear foil 4 which straddles the knife or cutter-block 5 (see FIG. 2). The elements 4 and 5 together constitute the beard cutter of the dryshaver. This construction is known per se in the art.

Located in the housing section 6 as shown in FIG. 2 is a long-hair trimmer which is mounted, in a manner to be discussed subsequently, on a first slide 8 that can be moved vertically (in FIGS. 1 and 2), and on or within the first slide 8 there is mounted a second slide 9 of which FIG. 1 shows only the engaging portion 10 and which activates and de-activates the motor-energizing switch of the dryshaver. In the position shown in FIG. 1 the long-hair trimmer 7 is located in its lowest inoperative position in which it is uncoupled from the drive of the dryshaver, and the operating member 10 of the slide 9 is itself in the lowest position in which the drive of the dryshaver is disconnected from the energy source.

Figure 4:
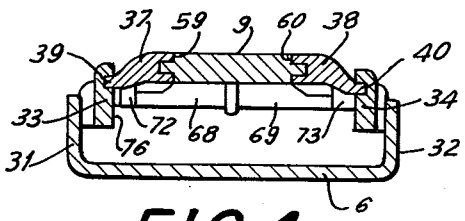
FIG. 4 is a section on line IV—IV of FIG. 3.
Figure 7:
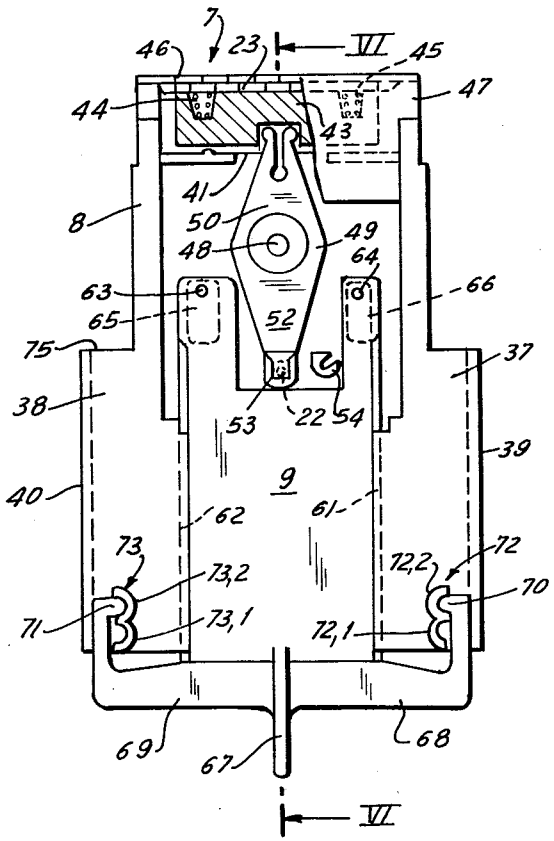
FIG. 7 is a rear view of the embodiment in FIGS. 5 and 6.
Figure 5:
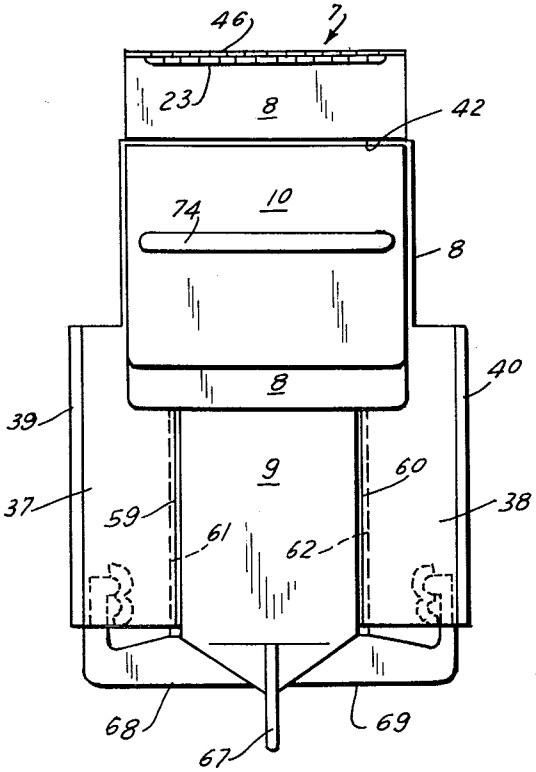
FIG. 5 is a front view of the slides and the motor-operating switch of the dryshaver.

FIG. 2 shows a swing-armature motor which is known per se and has a U-shaped ferrite core on which two coils 12 and 13 are mounted. Between plates 14 (of which only the upper one is visible) a swing arm 17 is journalled on a shaft 15, carrying the armature 16 and being biased by two vertical springs 18 and 19. The knife block 5 is coupled to the upper end 20 of the swing arm 17 and is pressed against the underside of the shear foil 4 by a biasing spring 21 which reacts against the swing arm 17. Located below the shaft 15 is a drive pin or connector 22 which is provided on the swing arm 17 and serves, in a manner to be described subsequently, to drive the cutter blade 23 of the long-hair trimmer 7. Inserted at the lower end of the housing 1 is the plate 24 of a printed circuit on which there are also mounted a voltage selecting switch 25 (e.g. to select 110 or 220 volt operation), a socket 26 for connection of the dryshaver to an external power supply, and two contact springs 27, 28 of the motor-energizing switch. In FIG. 2 both of the springs are in engagement with one another under their own stress, so that the switch is closed. Two wires 29 and 30 establish electrical connection from the printed circuit to the coils 12 and 13. Rails 33 and 34 are formed on the side walls 31 and 32 of the housing section 6 and are each provided with a longitudinal groove 35 and 36, respectively. The slide 8, which is shown on an enlarged scale in FIGS. 5–7, is slidably guided in the grooves 35 and 36 and is provided for this purpose with two portions 37 and 38 the longitudinal edges 39 and 40 of which correspond to the grooves 35 and 36 as shown in FIG. 4.

Figure 3:
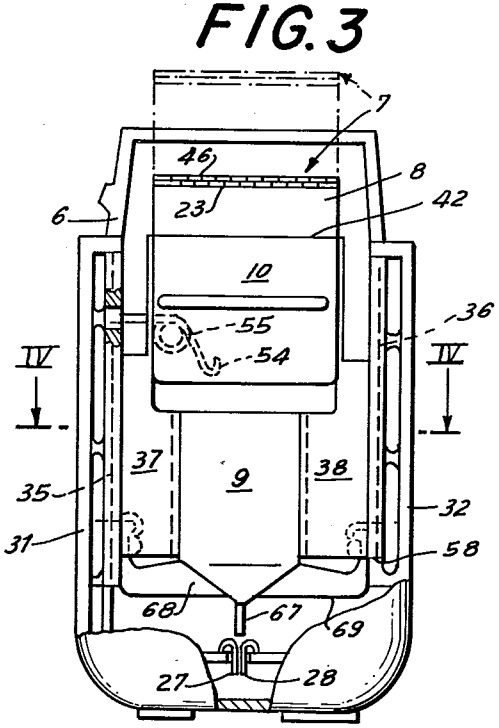
FIG. 3 is a view similar to FIG. 2, but with further elements omitted and other elements shown which are missing in FIG. 2.
Figure 6:
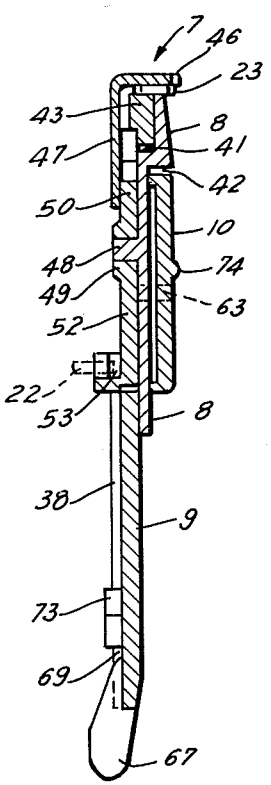
FIG. 6 is a section taken on line VI—VI of FIG. 7.

The upper end of the slide 8 is angled in such a manner that it forms a shoulder 41 and an abutment edge 42, as clearly shown in FIG. 6. A glide shoe 43 is shiftably mounted on the shoulder 41 and carries the cutter blade 23 which is pressed by springs 44, 45 against the stationary shear comb 46. The latter in turn is connected via an angled lug 47 to the upper end of the slide 8. Also mounted on the slide 8, and more particularly on a bolt 48 formed thereon, is a double-armed lever 49 which is pivotable and engages with its upper bifurcated arm 50 in a recess 51 of the glide shoe 43, whereas its other end 52 has an upwardly open pocket 53 cooperating with the drive bolt 22 of the swing lever 17, as shown in FIGS. 6 and 7. At the level of the pocket 43 the slide 8 is provided with a hair-pin-type spring 55 as shown in FIG. 3, the other end of which is engaged in a recess 56 of the rail 33. In cooperation with upper and lower end abutments 57 and 58 of the groove 36 the spring 55 provides for an over-center operation and determines the upper and lower end positions of the slide 8 and thereby of the long-hair trimmer 7. The slide 8 is cut out intermediate the portions 37 and 38 and the edges 59 and 60 of the cutout are also provided with grooves 61 and 62 in which the second slide 9 is guided. The latter is connected with the engaging portion 10 thereof via e.g. welding projections 63, 64 or in other suitable manner. The first slide 8 is provided with recesses 64, 66 corresponding in length to the displacement path of the second slide 9. A blade or knife 67 of electrically insulating material is provided at the lower end of the second slide 9 and engages in the lower end position between the contact springs 27, 28, separating them so as to interrupt the supply of electrical energy to the motor. At opposite sides of the blade 67 the slide 9 is formed with angled-off arms 68, 69. These have at their ends each a rounded head 70 and 71 and these heads cooperate with two-stage abutments 72 and 73 formed on the first slide 8. The lower first stages 72.1 respectively 73.1 of these abutments determine the de-energizing or operating position of the slide 9, as will be discussed subsequently.

When the dry shaver is in the de-energized position shown in FIG. 1, in which the member 10 is in the illustrated lower position, the heads 70 and 71 are engaged with the lower stages 72.1 and 73.1 of the abutments 72 and 73. In this position the blade 67 is located between the contact springs 27, 28 and separates the same from one another so that there is no flow of electrical energy from the external source to the motor. To start the dryshaver the member 10 is shifted upwardly (see FIG. 1) until it abuts the edge 42 of the first slide 8. During this movement the heads 70 and 71 move to the second stages 72.2 respectively 73.2 of the abutments 72, 73, and to permit such movement the arms 68 and 69 are sufficiently yieldable to move elastically outwardly away. Also during this movement the member 67 moves out from between the contacts 27, 28 so that these can engage one another, thus establishing a flow of electrical energy from the external source to the motor and starting the same. The armature 16 now drives the knife block 5 and reciprocates it (to and fro) via the swing arm 17 and thus the beard cutter is in operation. The long-hair trimmer 7, however, continues to remain in its inactive rest position (FIG. 1) and also it continues to be uncoupled from the drive.

If, now, it is desired to use the long-hair trimmer 7 then the member 10 is shifted further upwardly (for this purpose it may be provided with a rib 74 which makes it more readily engageable by the fingers of a user) and in so doing it takes along the slide 8 until the same abuts the upper edge 75 of the portion 38 on the abutment 57 of groove 36. The hair-pin 55 is pivoted past its dead center point and now holds the slides 8 and 9 in this uppermost position, as indicated in broken lines in FIG. 3. The bracket 53 of the arm 49 is shifted from above onto the bolt 22, as shown in FIGS. 6 and 7 and the arm 49 is now reciprocated to and fro by the bolt 22 transmitting such reciprocation via the slide shoe 43 to the cutter blade 23. During this movement the beard cutter itself (composed of the elements 4 and 5) continues to remain in operation.

Figure 8:
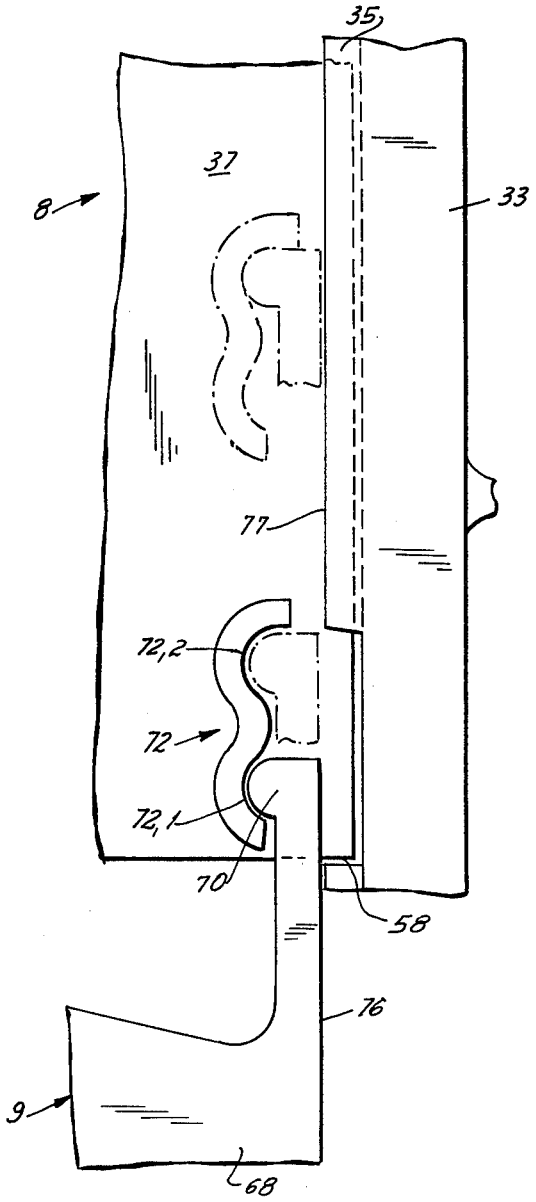
FIG. 8 is an enlarged detail view of FIGS. 5–7.

To uncouple the long-hair trimmer 7 from the motor, or rather from the drive bolt 22, the slide 9 is shifted downwardly by engagement and movement of the member 10 by the finger or fingers of a user. To prevent the slide 9 from accidentally being moved all the way to its end position, which would cause de-energization of the entire dryshaver, the measure illustrated in FIG. 8 may advantagcously be incorporated in the dryshaver construction. This measure will be seen to provide the cutout at the lower end of the rail 33 (the same is true for the other rail 34) along the groove 35, to such an extent that the arm 68 with its head 70 may, during the movement from the lower stage 72.1 of the abutment 72 into the upper stage 72.2 of the same, move freely, i.e. in this embodiment it can springily deflect to the right without hindrance. If, however, the arm 68 of the second slide 9 moves further upwardly, taking along the first slide 8, then the rear 67 of the arm 68 engages the edge 72 of the rail 33, so that the head 70 can no longer move out of the stage 72.2. In this manner, both slides 8 and 9 are coupled with one another in the manner shown in broken lines at the upper part of FIG. 8 and the problem mentioned before is avoided.

While the invention has been illustrated and described as embodied in a dryshaver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a dryshaver, a combination comprising a drive; a long-hair trimmer; a first slide mounting said trimmer and being movable to and from in operating position in which said trimmer is operatively coupled with said drive to be powered by the same; and switch means, including a second slide provided at and movable relative to said first slide, for energizing and de-energizing said drive.

2. A combination as defined in claim 1, wherein said second slide is mounted on said first slide.

3. A combination as defined in claim 2, said first slide being movable in a first path and said second slide being movable in a second path transverse to said first path.

4. A combination as defined in claim 2, said first and second slides both being movable along one and the same path.

5. A combination as defined in claim 1, said first slide being movable between a first and a second end position; and further comprising resilient means retaining said first slide in the respective end positions thereof.

6. A combination as defined in claim 1, said first slide having two abutments, and said second slide being movable between two end positions in which it engages the respective abutments.

7. A combination as defined in claim 1, said first slide also having a rest position; and further comprising biasing means for biasing said first slide towards said rest position.

8. A combination as defined in claim 7; further comprising a shearhead including a shearhead frame; and wherein said biasing means comprises prestressed biasing springs mounted in said shearhead frame.

9. A combination as defined in claim 7; further comprising a housing; and wherein said biasing means comprises prestressed biasing springs mounted in said housing.

10. A combination as defined in claim 1; further comprising means for releasably detaining said second slide in respective end positions of the same.

11. A combination as defined in claim 1, said switch means comprising an electrical switch having an actuating member, and said second slide being slidably mounted in a recess of said first slide and having a projection engageable with said actuating member in response to movement of said second slide relative to said first slide.

12. A combination as defined in claim 1; further comprising a housing; said first slide having a recess in which said second slide is movable, two abutments delimiting respective end positions of said second slide, and snap-in detents at said abutments for entry of said second slide; said housing having an abutment edge engaged with said second slide and maintaining the same in an end position corresponding to a de-energized position of said drive unless said first slide is in said operating position thereof.

* * * * *